US007780142B2

(12) United States Patent
Jessberger

(10) Patent No.: US 7,780,142 B2
(45) Date of Patent: Aug. 24, 2010

(54) OIL PAN FOR AN INTERNAL COMBUSTION ENGINE

(75) Inventor: Thomas Jessberger, Asperg (DE)

(73) Assignee: Mann+Hummel GmbH, Ludwigsburg (DE)

( * ) Notice: Subject to any disclaimer, the term of this patent is extended or adjusted under 35 U.S.C. 154(b) by 6 days.

(21) Appl. No.: 11/657,065

(22) Filed: Jan. 24, 2007

(65) Prior Publication Data

US 2007/0170388 A1 Jul. 26, 2007

(30) Foreign Application Priority Data

Jan. 24, 2006 (DE) ..... 20 2006 001 144 U

(51) Int. Cl.
*F16L 37/28* (2006.01)

(52) U.S. Cl. ..... 251/149.6; 251/101; 251/319

(58) Field of Classification Search ..... 251/149.6, 251/101, 102, 110, 339, 231, 235, 318–319; 349/1; 141/351, 384; 184/1.5
See application file for complete search history.

(56) References Cited

U.S. PATENT DOCUMENTS 1,597,455 A * 8/1926 Mills ..... 137/224
2,271,850 A * 2/1942 Zinkil ..... 236/80 R
3,433,385 A * 3/1969 Metivier ..... 220/293
3,799,432 A * 3/1974 Schneider ..... 236/48 R
4,311,272 A * 1/1982 Foller ..... 236/59
4,493,435 A * 1/1985 Hartley ..... 222/52
4,561,588 A * 12/1985 Foller ..... 236/59
5,449,218 A * 9/1995 Beauvais et al. ..... 297/216.19
5,697,410 A * 12/1997 Rutter et al. ..... 141/346
6,237,639 B1 * 5/2001 Jougla et al. ..... 137/899.2
6,312,409 B1 * 11/2001 Gross ..... 604/131
2003/0070876 A1 * 4/2003 Takahara ..... 184/1.5
2004/0154576 A1 * 8/2004 Kamiyama et al. ..... 123/195 C

FOREIGN PATENT DOCUMENTS

EP 1 041 253 B1 10/2000

* cited by examiner

*Primary Examiner*—John K Fristoe, Jr.
*Assistant Examiner*—Marina Tiet Jen

(57) ABSTRACT

An oil pan (1) provided with a drain mechanism (10) in which an adjustable valve body (11) is disposed in a drain opening (13) in the oil pan wall and is adjustable between a closed position and an open position. A sealing member (12) made of a flexible material is arranged on the valve body (11) of the drain mechanism (10) for closing the drain opening (13) in the oil pan wall when the valve body is in the closed position. The valve body (11) is secured by a closing element on the wall of the oil pan (1) when in the closed position, and the sealing member (12) is held in the closed position by the closing element.

7 Claims, 6 Drawing Sheets

OIL PAN FOR AN INTERNAL COMBUSTION ENGINE

BACKGROUND OF THE INVENTION

The present invention relates to an oil pan, in particular for an internal combustion engine, with a drain mechanism adjustable between open and closed positions.

Oil pans of this type, which are arranged on the underside of an internal combustion engine, must be designed to be stable to withstand high forces, to also withstand high mechanical influences which may occur, for example, from a stone strike or from the vehicle scraping the ground. Also known are oil pan embodiments made of metal or even a one-piece injection-molded part made of polyamide or polypropylene, as described in published European patent application no. EP 1,041,253. To be able to drain the oil out of the oil pan, a drain opening, which can be closed by an adjustable closing element, is provided in the bottom of the pan. In oil pans made of metal, this closing element may be constructed as an oil drain screw which is screwed into the drain opening under pressure via a copper gasket, so that a leak-proof condition is established. In oil pans made of synthetic resin material, a screw connection of the oil drain screw to the wall of the oil pan is problematic for strength reasons. Instead, threaded inserts may be used, which are inserted into the opening to be sealed. However, this is associated with a relatively great complexity and cost; Furthermore, there is a risk that the threaded insert may be ripped out if it is subjected to too much force.

SUMMARY OF THE INVENTION

It is an object of the present invention to provide an improved oil pan for an internal combustion engine.

Another object of the invention is to provide an oil pan with a drain mechanism having a simple, yet reliable design.

A further object of the invention is to provide an oil pan drain mechanism suitable for use in oil pans having a relatively thin wall or in oil pans made of synthetic resin material.

These and other objects have been achieved in accordance with the present invention by providing an oil pan for an internal combustion engine having a drain mechanism comprising an adjustable valve body inserted into a drain opening in an oil pan wall and adjustable between a closed position and an open position, wherein a sealing member made of a flexible material is arranged on said valve body for sealing the drain opening in the oil pan wall when the valve body is in the closed position, and wherein the valve body is secured in the closed position on the oil pan wall by a closing element which holds the sealing member in the closed position. Additional advantageous embodiments and refinements are described in further detail hereinafter.

In the oil pan of the invention, the drain mechanism comprises an adjustable valve body which is to be adjusted between a closed position that seals the drain opening in the wall of the oil pan and an open position that releases the drain opening. A sealing member made of a flexible material is provided on the valve body of the drain mechanism, sealing the drain opening in the closed position. In addition, the valve body is secured in its closed position with the aid of a closing element on the wall of the oil pan, and the closing element holds the sealing member which is held on the valve body in the closed position.

This embodiment has the advantage that a thread is not required in the wall of the oil pan bordering the drain openings, so it is possible to use oil pans made of metal having very thin walls as well as oil pans made of synthetic resin material. The sealing member on the valve body is held in the closed position with the help of the closing element, whereby the closing element is constructed separately from the valve body. In an advantageous embodiment, the sealing member is constructed as a spring element that acts on the valve body, forcing it into its closed, i.e., sealing position. According to another advantageous embodiment, the valve body performs an axial lifting movement during the conversion movement between its closed position and its open position, which has the advantage that the switch between the closed position and the open position of the valve body can be implemented with the help of simple control elements and in particular can be performed outside of the oil pan. The valve body is acted upon by the spring element, forcing it into the closed position, and is moved manually into the open position by an external component, e.g., a tool—optionally with the help of a control element—so that the drain opening is opened and the oil can escape from the pan. For a tight fit in the drain opening, it may be advantageous here for the sealing member to be arranged on the end face of the valve body and optionally to be constructed with a conical shape, so that a secure and tight sealing is supported. For opening the drain opening, the valve body including the sealing member arranged thereon is lifted out of the sealing position.

According to another preferred embodiment, an oil outlet connection may also be inserted into the drain opening from the outside for opening the valve body, whereby the oil outlet connection lifts the valve body including the sealing member out of the sealing seat in the drain opening. The oil outlet connection in this embodiment has a double function: first, the valve body is adjusted into the open position; secondly, the outlet connection is inserted tightly into the drain opening simultaneously with the lifting of the valve body, so that oil can flow out of the oil pan via the drain opening and the oil outlet connection. In this way, the engine can be filled with oil even at the initial assembly. Furthermore, an oil change can also be performed fully automatically.

The opening movement of the valve body is advantageously a lifting movement, in particular exclusively a lifting movement. However, it may also be advantageous to combine the lifting movement with a rotational movement, in particular a movement about the longitudinal axis of the valve body. A pure rotational movement may possibly also be considered.

The closing element, which acts on the valve body in the closed position, is held against the wall sections of the oil pan surrounding the drain opening. This has the advantage that no threaded insert need be introduced into the drain opening and/or it is not necessary to cut a thread directly in the wall bordering the drain opening. Therefore, the closing forces are distributed over a larger area of the wall of the oil pan, thereby preventing high force peaks which might result in damage to the oil pan.

According to an advantageous refinement, the closing element and/or the spring element is supported on an abutment, which is situated on the pan bottom of the oil pan and is fixedly joined to the wall of the oil pan. This abutment is constructed as a dome, for example, and extends over the drain opening, so that flow-through openings are advantageously provided in the abutment to establish a continuous flow connection between the drain opening and the inside of the oil pan. The closing forces are uniformly distributed on the wall of the oil pan through the abutment.

A locking device is advantageously provided by which the valve body is locked in the closed position on the oil pan. A locking lever that cooperates with the valve body may be considered as the locking device, for example, the locking lever to be adjusted between a operating position and a locking position, whereby in the operating position the valve body can be adjusted between its closed position and its open position.

Alternatively or in addition to the locking lever, a rocker arm guide may also be provided as the locking device, said rocker arm guide comprising a rocker arm path and a pin guided in the rocker arm path. The rocker arm path is formed on the valve body, for example. In this case, the pin engaging in the rocker arm path is fixedly connected to the oil pan and/or to a component connected to the oil pan. However, an embodiment with the pin fixedly arranged on the valve body and a rocker arm path on the oil pan and/or a component connected to the oil pan may also be considered.

The rocker arm path may be constructed in such a manner that rocker arm path sections running across the direction of lifting of the valve body may be provided, causing the valve body to be locked in the closed position and/or in the open position. These rocker arm path sections running across the lifting movement may also be combined with a roughened surface structure in the walls bordering the rocker arm path, so that the self-locking effect is improved.

BRIEF DESCRIPTION OF THE DRAWINGS

The invention will be described in further detail hereinafter with reference to illustrative preferred embodiments shown in the accompanying drawing figures, in which.

DETAILED DESCRIPTION OF PREFERRED EMBODIMENTS

Figure 1:
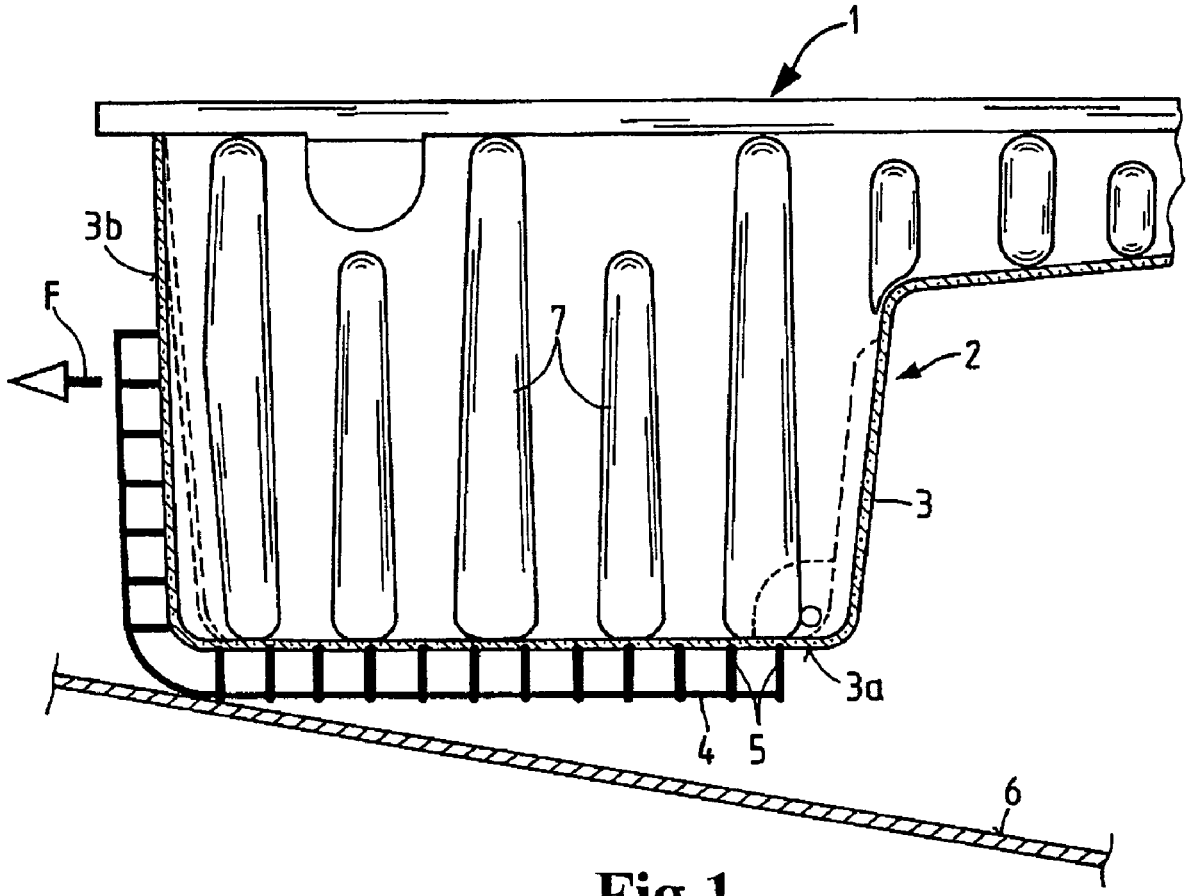
FIG. 1 is a side view of an oil pan for the internal combustion engine of a motor vehicle, in which the outside wall of the oil pan in the area of the bottom of the pan and the side walls situated at the front in the direction of travel are surrounded by a protective shell connected to the outside wall by a plurality of spacer elements.

In the figures, corresponding components are identified by the same reference numerals.

The oil pan 1 for an internal combustion engine of a motor vehicle as illustrated in FIG. 1 comprises an oil pan housing 2 made of synthetic resin material manufactured, in particular, by an injection molding process. The outside wall 3 of the oil pan housing 2 comprises a pan bottom 3*a* at the bottom and peripheral side walls 3*b*. The pan bottom 3*a* and the side walls 3*b*, which are at the front in the forward direction F of the vehicle, are surrounded by a protective wall and/or shell 4 which is constructed as a separate component and is connected to the pan bottom 3*a* and/or the front side wall 3*b* by spacer elements 5. The spacer elements 5 ensure that the protective shell 4 is spaced a distance from the outside wall 3 of the oil pan housing 2, so that an intervening space is formed between the outside wall 3 and the protective shell 4. The protective shell 4 and the spacer elements 5 likewise may be made advantageously of synthetic resin material. In accordance with one preferred embodiment, the protective shell 4 including the spacer elements 5 is integrally molded on the outside wall 3 of the oil pan. The protective shell 4 is concentric with the outside wall 3 of the oil pan. The spacing between the protective shell 4 and the outside wall 3 ensures that in the case of a stone impact or if the oil pan comes in contact with uneven ground 6, as shown in FIG. 1, initially only the outer protective shell 4 is damaged, whereas the outside wall 3 of the oil pan remains undamaged. High forces acting on the protective shell 4 are distributed uniformly across the outside wall of the oil pan via the plurality of spacer elements 5, which are constructed as struts or ribs, so that high local force peaks acting on the protective shell 4 are uniformly distributed over the entire outside wall of the oil pan in the manner of a surface load inasmuch as the protective shell 4 extends around the oil pan.

Additional ribs 7 may be constructed on the outside wall 3, reinforcing the outside wall and providing additional stability. These ribs 7 are arranged in the area of the side walls 3*b* as well as advantageously being arranged directly on the outside wall 3 in the area of the pan bottom 3*a*.

Figure 2:
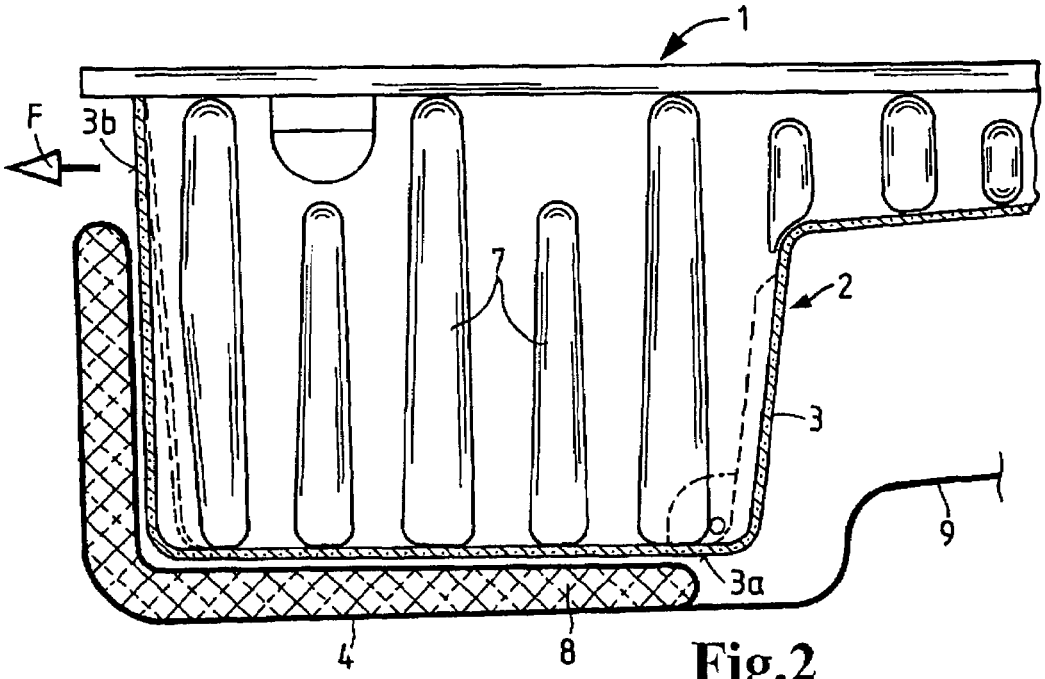
FIG. 2 is a view generally corresponding to FIG. 1 except that it has a protective shell which is part of an underbody, and an elastomeric damping element is provided in the intervening space between the protective shell and the outside wall of the oil pan.

In the illustrative embodiment depicted in FIG. 2, the protective shell 4 is comprised of a component of an underbody cover 9, which is provided on the underside of a vehicle. In the area situated at the front in the direction of travel F, the protective shell 4 extends around the front side wall 3*b*. Furthermore, the underbody 3*a* of the outside wall 3 of the oil pan is also surrounded. The protective shell 4 is spaced a distance from the outside wall 3, with a damping element 8 introduced into the intervening space between the outside wall 3 and the protective shell 4. The damping element 8 may, in particular, be made of an elastomer and is fixedly joined to the protective shell 4. The underbody cover 9 that is mounted on the vehicle, including the protective shell 4 forming the front area of the underbody cover, is advantageously not joined directly to the oil pan 1, but instead is mounted on another component of the motor vehicle. Because of the inherent stability of the underbody cover 9, the protective shell 4 is held in a fixed position in relation to the outside wall 3 of the oil pan 1. The damping element 8 also advantageously does not have a direct connection to the outside wall 3 of the oil pan.

In accordance with an alternative embodiment, however, it may also be advantageous to connect the damping element 8 to the outside wall 3, e.g., by adhesive bonding. Additionally or alternatively, it may be desirable to provide connecting elements for additionally connecting the protective shell 4 to the outside wall 3 of the oil pan 1.

Figure 3:
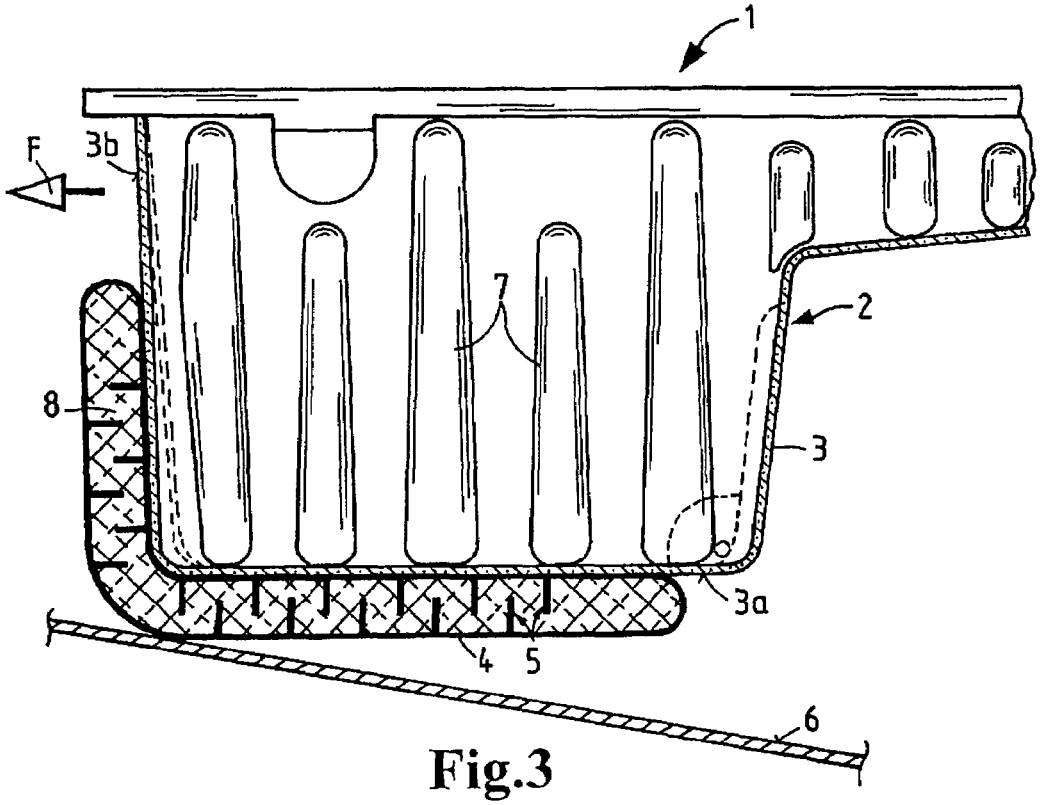
FIG. 3 shows another illustrative embodiment in which a protective shell is connected to the outside wall of the oil pan via a damping element, and stabilizing spacer elements protrude into, but do not penetrate through, the damping element.

In the illustrative embodiment shown in FIG. 3, the protective shell 4 is constructed as a separate independent component which is connected directly to the outside wall 3 of the oil pan 1. The connection between the protective shell 4 and the outside wall 3 is accomplished via the elastomer damping element 8, which is situated on the side of the protective shell 4 facing the oil pan 1. In addition, spacer elements 5 may also be provided, but as shown in the exemplary embodiment according to FIG. 3, they do not completely bridge the distance between the protective shell 4 and the outside wall 3 and thus they do not penetrate completely through the damping element 8 but instead merely protrude into the damping element. The spacer elements 5 are arranged alternately on the protective shell 4 and the bottom 3*a* of the pan and front side wall 3*b* of the outside wall. The connection of the protective shell 4 to the oil pan 1 is accomplished exclusively via the damping element 8, which is advantageously adhesively bonded to the outside wall 3 of the oil pan in this exemplary embodiment. Only in the case of a strong external influence on the protective shell 4 in the direction of the oil pan 1 and a resulting compression of the damping element 8 do the spacer elements 5, which do not penetrate completely through the damping element 8, have the task of absorbing additional supporting forces as soon as the protective shell 4 has approached the outside wall to such an extent that the spacer elements 5 are in contact with the opposite component.

Additional spacer elements may optionally also be provided, joining the protective shell 4 directly to the outside wall 3 of the oil pan.

Figure 4:
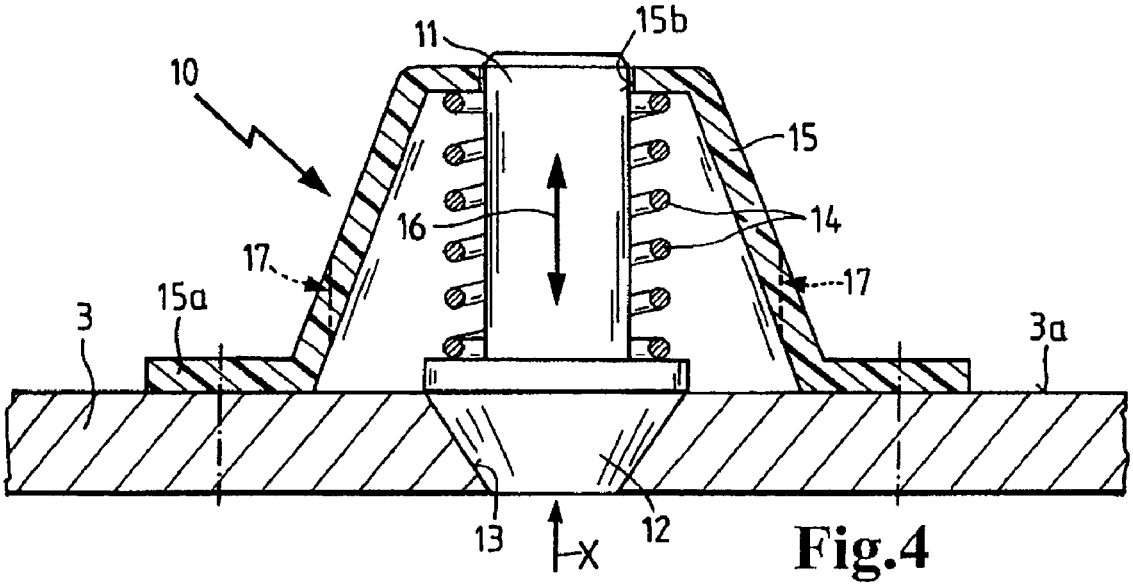
FIG. 4 is a sectional view through the pan bottom of an oil pan with a drain mechanism in a drain opening in the oil pan, in which the drain mechanism comprises a vertically adjustable valve body having a sealing member arranged at the end, and the valve body is acted upon by a spring which urges the valve body into the closed position.

FIG. 4 shows a section through the oil pan bottom wall 3*a* with a drain opening 13 introduced into the pan bottom to be closed by an adjustable drain mechanism 10. The drain mechanism 10 comprises a valve body 11, which can execute an axial lifting movement according to arrow 16 for opening and closing the drain opening 13. The valve body 11 is acted upon by a spring 14, which functions as a closing element to urge the valve body into its sealing, i.e., closed position. A sealing member 12 made of a soft flexible material is arranged on an end face of the valve body 11, and when the valve body 11 is in the closed position, the sealing member is inserted into the drain opening 13 in a sealing manner. The drain opening 13 has a conical cross section and tapers toward the outside of the wall 3. The sealing member 12 also has a cross section which is conical and is configured to mate with the drain opening 13. The valve body 11 is mounted within an abutment or hood 15 which is constructed as a dome and encloses the outlet opening 13. The abutment 15 has an annular peripheral shoulder 15*a* which rests on and is attached to the oil pan bottom wall 3*a*. In the upper area the abutment 15 has a central opening 15*b* through which the valve body 11 protrudes when in the open position. The spring 14 is constructed as a helical spring surrounding the cylindrical valve body 11, supported at one end against the abutment 15 and exerting a compressive force on the valve body 11 at the other end so that the spring urges the valve body into its closed position. The spring force exerted by the spring 14 thus represents the sealing force acting on the valve body 11 and sealing member 12. This sealing force is transmitted via the abutment 15 and the annular shoulder 15*a* to the pan bottom 3*a*.

To open the drain opening 13, the valve body 11 is axially raised out of the sealing, i.e., closed, position, e.g., by an axial force acting on the sealing member 12 from the outside in the direction indicated by arrow X. This axial force which acts against the sealing force of the spring 14 may be applied manually or with the aid of a suitable tool.

Figure 5:
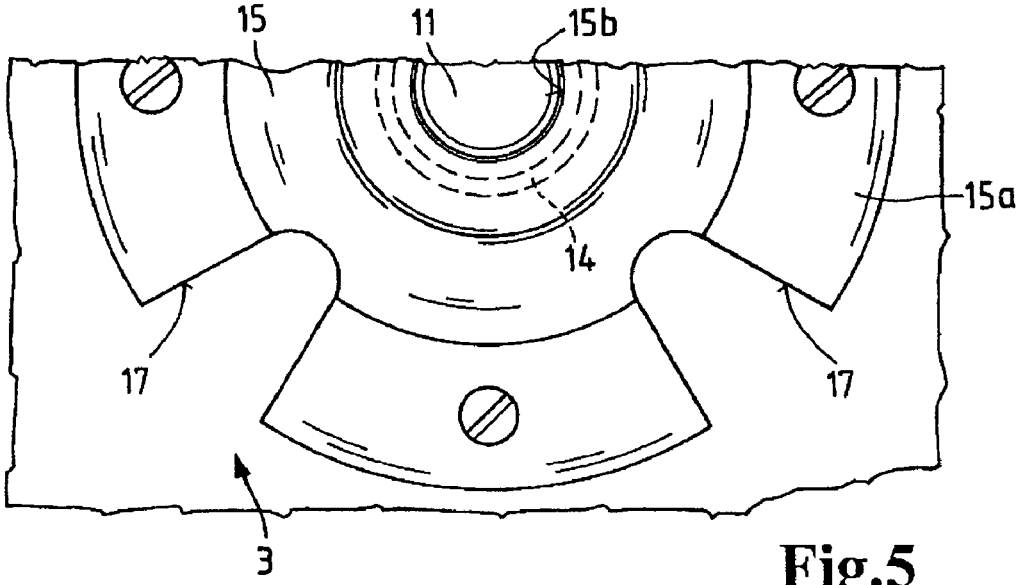
FIG. 5 shows a top view of the drain mechanism on the pan bottom.

As shown in FIG. 5, flow-through openings 17 are provided in the annular peripheral shoulder 15*a* of the abutment 15 distributed around the circumference at regular angular intervals. These flow-through openings 17 connect the interior of the abutment 15 to the interior of the oil pan. Oil in the oil pan can flow through the flow-through openings 17 into the interior of the abutment 15, and when the valve body 11 is opened, the oil can flow out through the drain opening 13.

Figure 6:
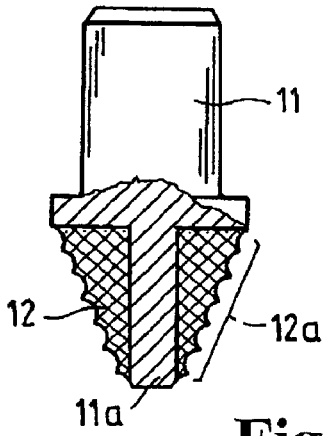
FIG. 6 shows a side view of another valve body embodiment with the sealing member arranged on the end.

FIG. 6 shows a side view of the valve body 11 and the sealing member 12 mounted on the end of the valve body 11. The sealing member 12 has a roughened surface structure 12*a*, so that the surface of the sealing member is softer and even relatively minor axial forces are sufficient to achieve the required high seal. In this embodiment, the sealing member 12 is seated on an optional spur 11*a* which protrudes beyond the end face of the valve body 11 into the sealing member 12.

Figure 7:
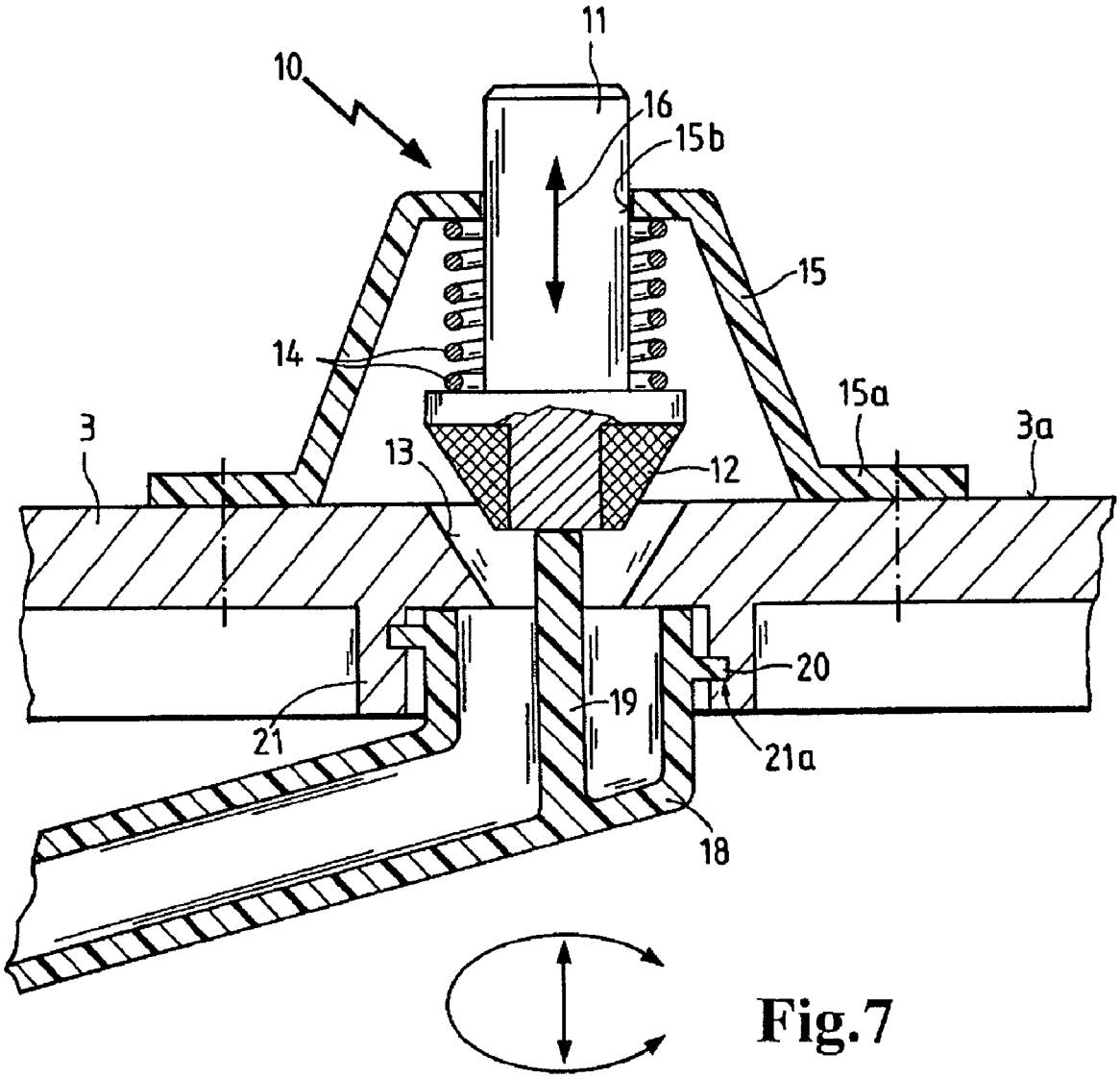
FIG. 7 is a sectional view through the pan bottom of a modified oil pan embodiment with a drain mechanism according to which an oil outlet connection can be inserted from the outside into the drain opening, and the valve body is lifted by an arm of the oil outlet connection, whereby the oil filling can also be performed in the same way.

FIG. 7 shows another illustrative embodiment. As in the preceding illustrative embodiment, the drain mechanism 10 comprises an axially movable valve body 11 which is acted upon by a helical spring 14 to urge the valve body toward the sealing position. A conical sealing member 12 constructed as a sealing stopper is situated on the end face of the valve body 11 and protrudes into the drain opening 13 in the closed position. The spring 14 is supported against the abutment 15.

In contrast with the previous illustrative embodiment, an axially protruding oil pan connection 21 into which an oil outlet connection or filling mechanism 18, which is constructed as a separate component independent of the oil pan housing, can be inserted, extends on the outside of the wall 3 in the area of the pan bottom. This oil outlet connection 18 is provided with an upwardly protruding central lifting arm 19, which functions to raise the valve body 11, including the sealing member 12, axially out of the sealing seat, so that the drain opening 13 is opened. In addition, oil can be drained out of and/or supplied to the oil pan through the outlet connection 18 and the drain opening 13, which is opened by the attached outlet connection 18. The oil outlet connection 18 may be locked by a bayonet type closure to the oil pan connection 21, which in this embodiment is constructed in one piece with the oil pan bottom wall. On the upper section of the oil outlet connection 18, there is a laterally protruding shoulder 20 that engages in a mating or complementary spiral receiving groove 21*a* on the inside of the oil pan connection 21, so that upon insertion of the oil outlet connection 18 into the groove in the oil pan connection 21, which is stationarily mounted on the housing, followed by a corresponding rotational movement of the oil outlet connection 18, the lifting arm 19 on the oil outlet connection 18 executes an axial lifting movement and raises the valve body together with the sealing member out of the sealing seat. In fully automatic filling and emptying, the bayonet may be omitted, and the oil outlet connection 18 simply pressed from the outside securely against the oil pan connection 21.

Figure 8:
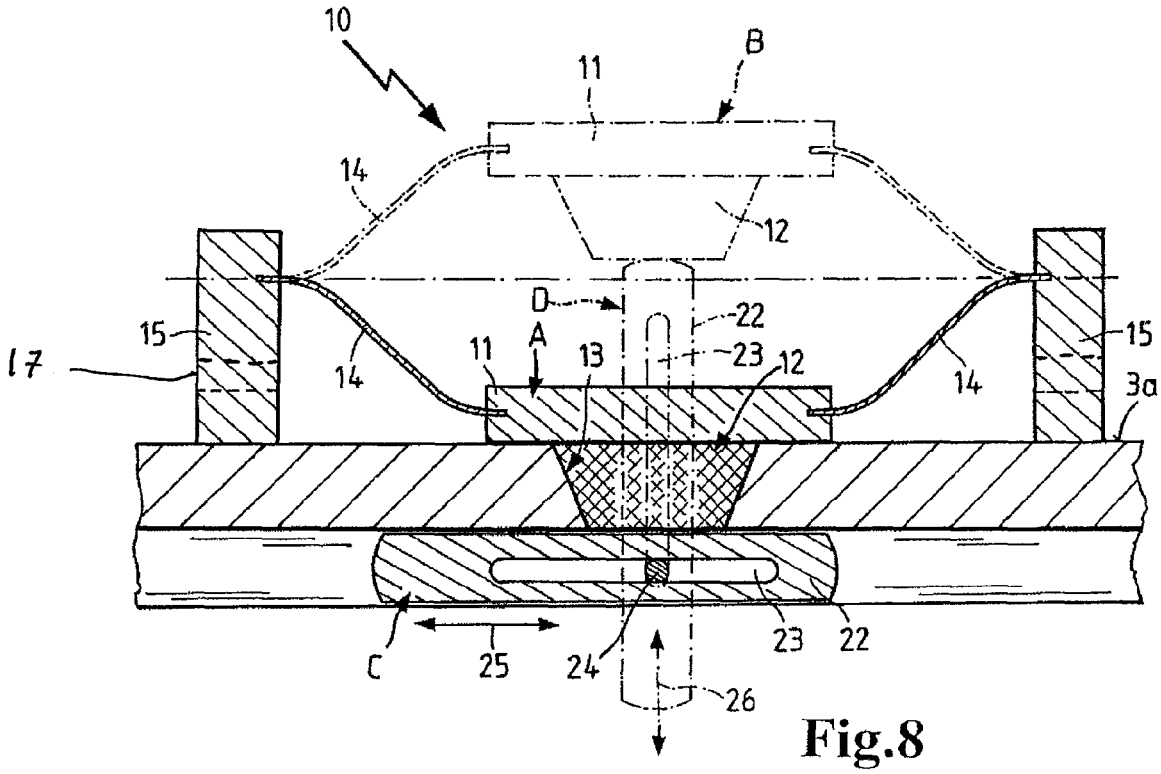
FIG. 8 shows a drain opening at the bottom of another oil pan embodiment in which the spring element which acts on the valve body to urge the valve body into the closed position is constructed as a plate spring.

In the illustrative embodiment according to FIG. 8, the spring 14 is constructed as a bistable plate spring, one end of which is supported on the abutment 15 constructed as a flange and the other end of which is secured to the valve body 11. A total of at least two plate springs 14 are provided mounted on oppositely arranged flange-like abutments 15. Each plate spring 14 is adjustable between a first stable position (position "A") indicated by solid lines in FIG. 8, in which the spring urges the valve body 11 into the closed position, and a second stable position (position "B"), indicated by broken lines in FIG. 8, in which the springs raise the valve body 11 to its open position. The conical sealing member 12, which is seated in the drain opening 13 when the valve body is in the closed position, is arranged on the underside of the valve body 11.

On the outside of the pan bottom 3*a*, there is a locking lever 22, which is adjustable between the locked position (position "C") represented by solid lines and an operating position (position "D") represented by broken lines. In the locked position "C", the locking lever 22 is in contact with the underside of the pan bottom 3*a* covering the drain opening 13 in the pan bottom and extends transversely to the direction of any lifting movement. A slot 23 extending in the longitudinal direction of the locking lever is provided in the locking lever 22, and a pin 24 that is fixedly mounted on the housing is provided engaging in the slot 23. The slot 23 may also be constructed as an inclined plane, so that the sealing force is increased when the locking lever is shifted in the direction of the arrow 25. A catch position or an end position may also be defined on the inclined plane. In position C of the locking lever 22 extending along the pan bottom, as indicated by the solid lines, the locking lever may move in the direction indicated by the double arrow 25, i.e., along the outside of the pan bottom, but the locking lever cannot move in the lifting direction of the valve body.

By horizontal displacement, the locking lever 22 can be brought into a position in which the pin 24 is in contact with one end of the slot 23, whereupon the locking lever 22 can be pivoted 90° out of the horizontal position C into a vertical position D. In the vertical position D, the locking lever 22 can be moved up and down in the lifting direction of the valve body 11 as indicated by the double arrow 26. In the vertical position, an axial end face of the locking lever 22 is in contact with the underside of the sealing member 12, so the sealing member 12 can be raised against the sealing force of the plate springs 14 out of its sealing position in the drain opening.

As soon as the centerline between the mounting points of the plate springs 14 on the respective abutments 15 has been crossed, the valve body 11 and sealing member 12 spring upward under the influence of the plate springs into the upper stable position B of the plate springs (top dead center effect). The locking lever 22 can be moved upwardly with the valve body until the pin 24, which is in a fixed position on the housing, contacts the lower end of the slot 23.

Figure 9:
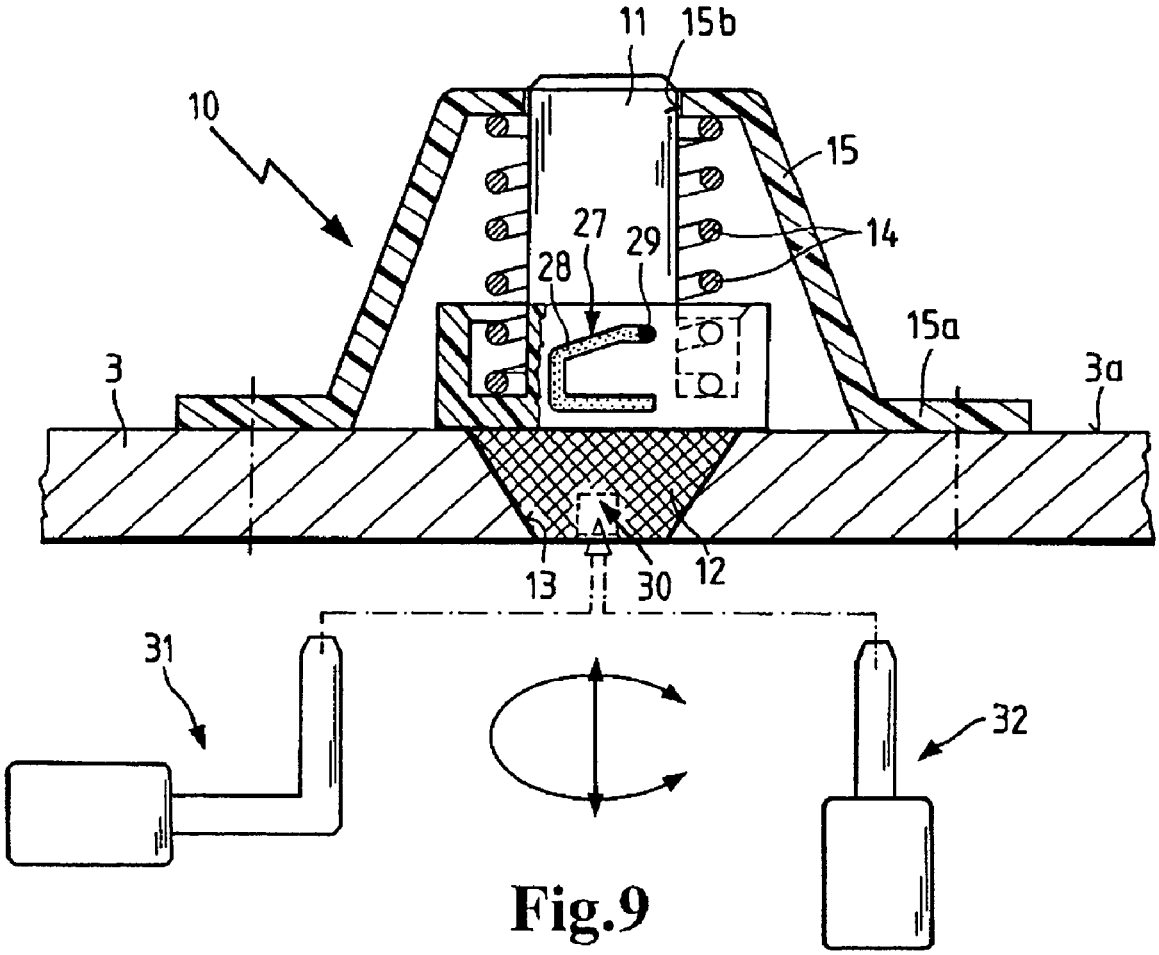
FIG. 9 is a sectional view through the pan bottom with yet another drain mechanism embodiment, with a rocker arm guide of a drain mechanism by which the valve body can be securely locked in its end positions.
Figure 10:
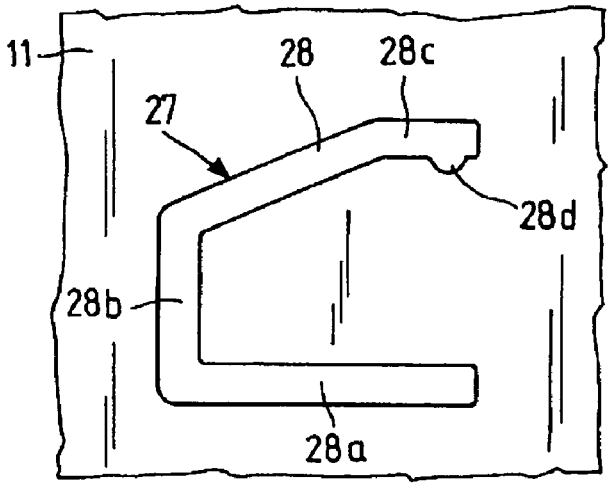
FIG. 10 is a diagram showing and enlarged view of the rocker arm path of the rocker arm guide.

In the illustrative embodiment according to FIG. 9, the cylindrical valve body 11 is acted upon by a helical spring 14, urging it into the sealing (i.e., closed) position as in the embodiments depicted in FIGS. 5 and 7, with the spring 14 being supported against a dome-shaped abutment 15. In addition, a locking mechanism constructed as a rocker arm guide 27 is provided, comprising a rocker arm path 28 connected to the valve body 11 and a rocker arm pin 29, which is fixedly attached to the housing, in particular being attached fixedly to the abutment 15. As shown by the enlarged diagram of the rocker arm path 28 according to FIG. 10, the rocker arm path 28 has a plurality of sections 28*a* through 28*c*, whereby the end sections 28*a* and 28*c* extend horizontally, i.e., transversely to the direction of lift of the valve body 11, and thus represent the catch positions and/or locking positions for the valve body 11. If the rocker arm pin 29 is either in the horizontal lower section 28*a* or in the horizontal upper section 28*c* of the rocker arm path 28, a lifting movement, i.e., a translational movement, in the direction of the longitudinal axis of the valve body 11 is impossible. However, switching between the closed position and the open position of the valve body 11 is possible in the vertical section 28*b* of the rocker arm path, whereby the vertical section 28*b* extends in parallel to the longitudinal axis of the valve body 11. If the rocker arm pin 29 is in the vertical section 28*b*, then the valve body 11 can be adjusted between its sealing position and its open position.

A recess 30 is formed in the end face of the sealing member 12 so that a suitable tool 31 and/or 32 for switching the valve body 11 and the sealing member 12 between the closed position and the open position can engage in this recess. The tool 31 is an angled tool for lifting and rotating the valve body 11 according to the rocker arm path 28, which links a rotational movement and a lifting movement. The tool 32 may be a screwdriver. A convexity path section 28*d*, which represents a catch position, is located in the end area of the upper horizontal section 28*c* of path 28. If the rocker arm pin 29 is in the convexity 28*d*, then the valve body 11 is in a catch position. This catch position is associated with the sealing position, i.e., the closed position of the valve body 11 so that the valve body is held in the closed position.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. An oil pan for an internal combustion engine, said oil pan having a drain mechanism that comprises an adjustable valve body which is inserted into a drain opening in an oil pan wall and which is adjustable between a closed position and an open position, wherein a sealing member made of a flexible material is seated in the drain opening and arranged on the underside of said valve body for sealing the drain opening in the oil pan wall when the valve body is in the closed position, and wherein the valve body is secured in the closed position on the oil pan wall by a closing element which holds the sealing member in the closed position, wherein the closing element comprises a spring, including a bistable plate spring configured to be alternately disposed in two stable positions corresponding to the closed and open positions of the valve body, respectively;

wherein a locking mechanism operable to mechanically open as well as close said adjustable valve body between said alternately disposed stable positions, said locking mechanism including a locking lever, said locking lever extending transversely to a direction of valve body movement and contacting an underside of said oil an when in a locked position lockably closing said valve body;

said locking lever rotatable to an operating position in which said locking lever contacts an underside of said sealing member urging said valve body into said open position, said locking lever returnable to said locked position in which said valve body is urged from said open position to return to said closed position.

2. An oil pan according to claim 1, wherein the valve body executes an axial lifting movement when adjusted between the closed position and the open position.

3. An oil pan according to claim 1, wherein the sealing member comprises a sealing stopper which, in the closed position, is sealingly seated in the drain opening.

4. An oil pan according to claim 1, wherein the closing element is supported on an abutment which is arranged on a bottom wall of the oil pan and is fixedly connected to the wall of the oil pan.

5. An oil pan according to claim 4, wherein the abutment surrounds the drain opening in the oil pan wall, and flow-through openings are provided in the abutment.

6. An oil pan according to claim 1, wherein the valve body is opened toward the inside of the pan.

7. An oil pan according to claim 1, wherein the oil pan is made of a synthetic resin material.

* * * * *